US007215287B2

(12) United States Patent
Quintero Illera et al.

(10) Patent No.: US 7,215,287 B2
(45) Date of Patent: May 8, 2007

(54) MULTIBAND ANTENNA

(75) Inventors: Ramiro Quintero Illera, Barcelona (ES); Carles Puente Baliarda, Barcelona (ES)

(73) Assignee: Fractus S.A., Barcelona (ES)

( * ) Notice: Subject to any disclaimer, the term of this patent is extended or adjusted under 35 U.S.C. 154(b) by 0 days.

(21) Appl. No.: 10/823,257

(22) Filed: Apr. 13, 2004

(65) Prior Publication Data

US 2004/0257285 A1 Dec. 23, 2004

Related U.S. Application Data

(63) Continuation of application No. PCT/EP01/11912, filed on Oct. 16, 2001.

(51) Int. Cl.
*H01Q 1/24* (2006.01)

(52) U.S. Cl. ..... 343/702; 343/700 MS

(58) Field of Classification Search ..... 343/700 MS, 343/702, 895, 846, 700, 800
See application file for complete search history.

(56) References Cited

U.S. PATENT DOCUMENTS

| | | | |
|---|---|---|---|
| 3,521,284 | A | 7/1970 | Shelton, Jr. et al. |
| 3,599,214 | A | 8/1971 | Altmayer |
| 3,622,890 | A | 11/1971 | Fujimoto et al. |
| 3,683,376 | A | 8/1972 | Pronovost |
| 3,818,490 | A | 6/1974 | Leahy |
| 3,967,276 | A | 6/1976 | Goubau |
| 3,969,730 | A | 7/1976 | Fuchser |
| 4,024,542 | A | 5/1977 | Ikawa et al. |
| 4,131,893 | A | 12/1978 | Munson et al. |
| 4,141,016 | A | 2/1979 | Nelson |
| 4,471,358 | A | 9/1984 | Glasser |
| 4,471,493 | A | 9/1984 | Schober |
| 4,504,834 | A | 3/1985 | Garay et al. |
| 4,543,581 | A | 9/1985 | Nemet |
| 4,571,595 | A | 2/1986 | Phillips et al. |
| 4,584,709 | A | 4/1986 | Kneisel et al. |

(Continued)

FOREIGN PATENT DOCUMENTS

| | | |
|---|---|---|
| DE | 3337941 | 5/1985 |

(Continued)

OTHER PUBLICATIONS

Ali, M. et al., "A Triple-Band Internal Antenna for Mobile Hand-held Terminals, " IEEE, pp. 32-35 (1992).

(Continued)

*Primary Examiner*—Tho Phan
(74) *Attorney, Agent, or Firm*—Jenkens & Gilchrist, P.C.

(57) ABSTRACT

The present invention relates generally to a new family of antennas with a multiband behaviour, so that the frequency bands of the antenna can be tuned simultaneously to the main existing wireless services. In particular, the invention consists of shaping at least one of the gaps between some of the polygons of the multilevel structure in the form of a non-straight curve, shaped in such a way that the whole gap length is increased yet keeping its size and the same overall antenna size. Such a configuration allows an effective tuning of the frequency bands of the antenna, such that with the same overall antenna size, said antenna can be effectively tuned simultaneously to some specific services, such as for instance the five frequency bands that cover the services AMPS, GSM900, GSM1800, PCS1900, UMTS, Bluetooth™, IEEE802.11b, or HyperLAN.

49 Claims, 7 Drawing Sheets

U.S. PATENT DOCUMENTS

| | | | | |
|---|---|---|---|---|
| 4,590,614 | A | 5/1986 | Erat | |
| 4,623,894 | A | 11/1986 | Lee et al. | |
| 4,673,948 | A | 6/1987 | Kuo | |
| 4,730,195 | A | 3/1988 | Phillips et al. | |
| 4,839,660 | A | 6/1989 | Hadzoglou | |
| 4,843,468 | A | 6/1989 | Drewery | |
| 4,847,629 | A | 7/1989 | Shimazaki | |
| 4,849,766 | A | 7/1989 | Inaba et al. | |
| 4,857,939 | A | 8/1989 | Shimazaki | |
| 4,890,114 | A | 12/1989 | Egashira | |
| 4,894,663 | A | 1/1990 | Urbish et al. | |
| 4,907,011 | A | 3/1990 | Kuo | |
| 4,912,481 | A | 3/1990 | Mace et al. | |
| 4,975,711 | A | 12/1990 | Lee | |
| 5,030,963 | A | 7/1991 | Tadama | |
| 5,138,328 | A | 8/1992 | Zibrik et al. | |
| 5,168,472 | A | 12/1992 | Lockwood | |
| 5,172,084 | A | 12/1992 | Fiedziuszko et al. | |
| 5,200,756 | A | 4/1993 | Feller | |
| 5,214,434 | A | 5/1993 | Hsu | |
| 5,218,370 | A | 6/1993 | Blaese | |
| 5,227,804 | A | 7/1993 | Oda | |
| 5,227,808 | A | 7/1993 | Davis | |
| 5,245,350 | A | 9/1993 | Sroka | |
| 5,248,988 | A | 9/1993 | Makino | |
| 5,255,002 | A | 10/1993 | Day | |
| 5,257,032 | A | 10/1993 | Diamond et al. | |
| 5,347,291 | A | 9/1994 | Moore | |
| 5,355,144 | A | 10/1994 | Walton et al. | |
| 5,355,318 | A | 10/1994 | Dionnet et al. | |
| 5,373,300 | A | 12/1994 | Jenness et al. | |
| 5,402,134 | A | 3/1995 | Miller et al. | |
| 5,420,599 | A | 5/1995 | Erkocevic | |
| 5,422,651 | A | 6/1995 | Chang | |
| 5,451,965 | A | 9/1995 | Matsumoto | |
| 5,451,968 | A | 9/1995 | Emery | |
| 5,453,751 | A | 9/1995 | Tsukamoto et al. | |
| 5,457,469 | A | 10/1995 | Diamond et al. | |
| 5,471,224 | A | 11/1995 | Barkeshli | |
| 5,493,702 | A | 2/1996 | Crowley et al. | |
| 5,495,261 | A | 2/1996 | Baker et al. | |
| 5,534,877 | A | 7/1996 | Sorbello et al. | |
| 5,537,367 | A | 7/1996 | Lockwood et al. | |
| 5,684,672 | A | 11/1997 | Karidis et al. | |
| 5,712,640 | A | 1/1998 | Andou et al. | |
| 5,767,811 | A | 6/1998 | Mandai et al. | |
| 5,798,688 | A | 8/1998 | Schofield | |
| 5,821,907 | A | 10/1998 | Zhu et al. | |
| 5,841,403 | A | 11/1998 | West | |
| 5,867,126 | A * | 2/1999 | Kawahata et al. | 343/702 |
| 5,870,066 | A | 2/1999 | Asakura et al. | |
| 5,872,546 | A | 2/1999 | Ihara et al. | |
| 5,898,404 | A | 4/1999 | Jou | |
| 5,903,240 | A | 5/1999 | Kawahata et al. | |
| 5,926,141 | A | 7/1999 | Lindenmeier et al. | |
| 5,943,020 | A | 8/1999 | Liebendoerfer et al. | |
| 5,966,097 | A * | 10/1999 | Fukasawa et al. | 343/700 MS |
| 5,966,098 | A | 10/1999 | Qi et al. | |
| 5,973,651 | A | 10/1999 | Suesada et al. | |
| 5,986,610 | A | 11/1999 | Miron | |
| 5,990,838 | A | 11/1999 | Burns et al. | |
| 6,002,367 | A | 12/1999 | Engblom et al. | |
| 6,028,568 | A | 2/2000 | Asakura et al. | |
| 6,031,499 | A | 2/2000 | Dichter | |
| 6,031,505 | A | 2/2000 | Qi et al. | |
| 6,078,294 | A | 6/2000 | Mitarai | |
| 6,091,365 | A | 7/2000 | Derneryd et al. | |
| 6,097,345 | A | 8/2000 | Walton | |
| 6,104,349 | A | 8/2000 | Cohen | |
| 6,127,977 | A | 10/2000 | Cohen | |
| 6,131,042 | A | 10/2000 | Lee et al. | |
| 6,140,969 | A | 10/2000 | Lindenmeier et al. | |
| 6,140,975 | A | 10/2000 | Cohen | |
| 6,160,513 | A | 12/2000 | Davidson et al. | |
| 6,172,618 | B1 | 1/2001 | Hakozaki et al. | |
| 6,211,824 | B1 | 4/2001 | Holden et al. | |
| 6,218,992 | B1 | 4/2001 | Sadler et al. | |
| 6,236,372 | B1 | 5/2001 | Lindenmeier et al. | |
| 6,252,554 | B1 * | 6/2001 | Isohatala et al. | 343/700 MS |
| 6,266,023 | B1 | 7/2001 | Nagy et al. | |
| 6,281,846 | B1 | 8/2001 | Puente Baliarda et al. | |
| 6,307,511 | B1 | 10/2001 | Ying et al. | |
| 6,329,951 | B1 | 12/2001 | Wen et al. | |
| 6,329,954 | B1 | 12/2001 | Fuchs et al. | |
| 6,366,243 | B1 * | 4/2002 | Isohatala et al. | 343/700 MS |
| 6,367,939 | B1 | 4/2002 | Carter et al. | |
| 6,407,710 | B2 | 6/2002 | Keilen et al. | |
| 6,417,810 | B1 | 7/2002 | Huels et al. | |
| 6,431,712 | B1 | 8/2002 | Turnbull | |
| 6,445,352 | B1 | 9/2002 | Cohen | |
| 6,452,549 | B1 | 9/2002 | Lo | |
| 6,452,551 | B1 * | 9/2002 | Chen | 343/700 MS |
| 6,452,553 | B1 | 9/2002 | Cohen | |
| 6,476,766 | B1 | 11/2002 | Cohen | |
| 6,476,767 | B2 * | 11/2002 | Aoyama et al. | 343/700 MS |
| 6,525,691 | B2 | 2/2003 | Varadan et al. | |
| 6,545,640 | B1 | 4/2003 | Herve et al. | |
| 6,552,690 | B2 | 4/2003 | Veerasamy | |
| 6,606,062 | B2 | 8/2003 | Kouam et al. | |
| 6,664,932 | B2 | 12/2003 | Sabet et al. | |
| 2002/0000940 | A1 | 1/2002 | Moren et al. | |
| 2002/0000942 | A1 | 1/2002 | Duroux | |
| 2002/0003499 | A1 | 1/2002 | Kouam et al. | |
| 2002/0036594 | A1 | 3/2002 | Gyenes | |
| 2002/0105468 | A1 | 8/2002 | Tessler et al. | |
| 2002/0109633 | A1 | 8/2002 | Ow et al. | |
| 2002/0126054 | A1 | 9/2002 | Fuerst et al. | |
| 2002/0126055 | A1 | 9/2002 | Lindenmeler et al. | |
| 2002/0175866 | A1 | 11/2002 | Gram | |
| 2004/0217916 | A1 | 11/2004 | Illera et al. | |

FOREIGN PATENT DOCUMENTS

| | | |
|---|---|---|
| EP | 0096847 | 12/1983 |
| EP | 0297813 | 8/1988 |
| EP | 0358090 | 8/1989 |
| EP | 0543645 | 5/1993 |
| EP | 0571124 | 11/1993 |
| EP | 0688040 | 12/1995 |
| EP | 0765001 | 3/1997 |
| EP | 0814536 | 12/1997 |
| EP | 0892459 | 1/1999 |
| EP | 0929121 | 7/1999 |
| EP | 0932219 | 7/1999 |
| EP | 0871238 | 10/1999 |
| EP | 0969375 | 1/2000 |
| EP | 0986130 | 3/2000 |
| EP | 0942488 | 4/2000 |
| EP | 0997974 | 5/2000 |
| EP | 1018777 | 7/2000 |
| EP | 1018779 | 7/2000 |
| EP | 1071181 | 1/2001 |
| EP | 1079462 | 2/2001 |
| EP | 1083624 | 3/2001 |
| EP | 1094545 | 4/2001 |
| EP | 1096602 | 5/2001 |
| EP | 1128466 | 8/2001 |
| EP | 1148581 | 10/2001 |
| EP | 1198027 | 4/2002 |
| EP | 1237224 | 9/2002 |
| EP | 1267438 | 12/2002 |
| ES | 2112163 | 3/1998 |
| ES | 2142280 | 5/1998 |
| FR | 2543744 | 10/1984 |

| | | |
|---|---|---|
| FR | 2704359 | 10/1994 |
| GB | 2215136 | 9/1989 |
| GB | 2330951 | 5/1999 |
| GB | 2355116 | 4/2001 |
| JP | 95147806 | 11/1980 |
| JP | 5007109 | 1/1993 |
| JP | 5129816 | 5/1993 |
| JP | 5267916 | 10/1993 |
| JP | 5347507 | 12/1993 |
| JP | 6204908 | 7/1994 |
| JP | 10209744 | 8/1998 |
| WO | 9511530 | 4/1995 |
| WO | 9627219 | 9/1996 |
| WO | 9629755 | 9/1996 |
| WO | 9638881 | 12/1996 |
| WO | 9706578 | 2/1997 |
| WO | 9711507 | 9/1997 |
| WO | 9732355 | 9/1997 |
| WO | 9733338 | 9/1997 |
| WO | 9735360 | 9/1997 |
| WO | 9747054 | 12/1997 |
| WO | 09836469 | 8/1998 |
| WO | 9812771 | 9/1998 |
| WO | 9903166 | 1/1999 |
| WO | 9903167 | 1/1999 |
| WO | 9925042 | 3/1999 |
| WO | 9927608 | 6/1999 |
| WO | 9956345 | 11/1999 |
| WO | 0001028 | 1/2000 |
| WO | 0003453 | 1/2000 |
| WO | 0022695 | 4/2000 |
| WO | 0036700 | 6/2000 |
| WO | 0049680 | 8/2000 |
| WO | 0052784 | 9/2000 |
| WO | 0052787 | 9/2000 |
| WO | 0103238 | 1/2001 |
| WO | 0108257 | 2/2001 |
| WO | 0113464 | 2/2001 |
| WO | 0117064 | 3/2001 |
| WO | 0122528 | 3/2001 |
| WO | 0124314 | 4/2001 |
| WO | 0126182 | 4/2001 |
| WO | 0128035 | 4/2001 |
| WO | 0131739 | 5/2001 |
| WO | 0133665 | 5/2001 |
| WO | 0135491 | 5/2001 |
| WO | 0137369 | 5/2001 |
| WO | 0137370 | 5/2001 |
| WO | 0141252 | 6/2001 |
| WO | 0148861 | 7/2001 |
| WO | 0154225 | 7/2001 |
| WO | 0173890 | 10/2001 |
| WO | 0178192 | 10/2001 |
| WO | 0182410 | 11/2001 |
| WO | 0235646 | 5/2002 |
| WO | 02091518 | 11/2002 |
| WO | 02096166 | 11/2002 |
| WO | WO-02/095874 | 11/2002 |
| WO | WO-03/023900 | 3/2003 |

OTHER PUBLICATIONS

Romeu, Jordi et al., "A Three Dimensional Hilbert Antenna," IEEE, pp. 550-553 (2002).

Parker et al., "Microwaves, Antennas & Propagation, " IEEE Proceedings H, pp. 19-22 (Feb. 1991).

Hansen, R.C., "Fundemental Limitations in Antennas," Proceedings of the IEEE, vol. 69, No. 2, pp. 170-182 (Feb. 1981).

Jaggard, Dwight L., "Fractal Electrodynamics and Modeling, " Directions in Electromagnetic Wave Modeling, pp. 435-446 (1991).

Hohlfeld, Robert G. et al, "Self-Similarity and the Geometric Requirements for Frequency Independence in Antennas," Fractals, vol. 7, No. 1, pp. 79-84 (1999).

Samavatt, Hirad, et al., "Fractal Capacitors, " IEEE Journal of Soild-State Circuits, vol. 33, No. 12, pp. 2035-2041 (Dec. 1998).

Pribetich, P., et al., "Quaalfractal Planar Microstrip Resonators for Microwave Circuits, " Microwave and Optical Technologgy Letters, vol. 21, No. 6, pp. 433-436 (Jun. 20, 1999).

Zhang, Dawei et al., "Narrowband Lumped-Element Microstrip Filters Using Capacitively-Loaded Inductors, " IEEE MTT-S Microwave Symposium Digest, pp. 379-382 (May 16, 1995).

Gough, C.E., et al., "High To coplanar resonators for microwave applications and scientific studies, " Physics C NL, North-Holland Publishing, Amsterdam, vol. 282-287, No. 2001, pp. 395-398 (Aug. 1, 1977).

Radio Engineering Reference-Book by H. Meinke and F.V. Gundiah, vol. 1, Radio components, Circuits with humped parameters. Transmission lines. Wave-guides. Resonators, Arrays, Radio waves propagatlom, States Energy Publishing House, Moscow, with English translation (1961) [4 pp.].

V.A. Volgov, "Parts and Units of Radio Electronic Equipment (Design & Computation)," Energiya, Moscow, with English Translation (1967) [4 pp.].

Puento, C., et al., "Multiband properties of a fractal tree antenna generated by electrochemical deposition," Electronics Letters, IEE Stevenage, GB, vol. 32, No. 25, pp. 2298-2299 (Dec. 5, 1996).

Puente, C., et al., "Small but long Koch fractel monopole," Electronics Letters, IEE Stevenage, GB, vol. 34, No. 1, pp. 9-10 (Jan. 8, 1998).

Puente Baliards, Carles, et al., "The Koch Monopole: A Small Fractal Antenna," IEEE Transactions on Antennas and Propagation, New York, US, vol. 48, No. 11, pp. 1773-1781 (Nov. 1, 2000).

Cohen, Nathan, "Fractal Antenna Applications in Wireless Telecommunications, " Electronics Industries Forum of New England, 1997. Professional Program Proceedings Boston, MA US, May 6-8, 1997, New York, NY US, IEEE, US pp. 43-49 (May 6, 1997).

Anguera, J. et al. "Miniature Wideband Stacked Microstrip Patch Antenna Based on the Sierpinski Fractal Geometry," IEEE Antennas and Propagation Society Internatioanl Symposium, 2000 Digest. Aps., vol. 3 of 4, pp. 1700-1703 (Jul. 16, 2000).

Hara Prasad, R. V., et al., "Microstrip Fractal Patch Antenna for Multi-Band Communication," Electronics Letters, IEE Stevenage, GB, vol. 36, No. 14, pp. 1179-1180 (Jul. 6, 2000).

Borja, C. et al., "High Directive fractal Boundary Microstrip Patch Antenna," Electronics Letters, IEE Stevenage, GB, vol. 36, No. 9, pp. 778-779 (Apr. 27, 2000).

Sanad, Mohamed, "A Compact Dual-Broadband Microstrip Antenna Having Both Stacked and Planar Parasitic Elements," IEEE Antennas and Propagation Society International Symposium. 1996 Digest, Jul. 21-26, 1995, pp. 6-9.

"Small Ciculatory Polarized Microstrip Antennas" by Wen-Shyang Chen, department of Electronic Engineering, Cheng-Shiu Institute of Technology, 1999 IEEE.

Jani Ollikaninen et al., "Internal Dual-Band Patch Antanna for Mobile Phones", European Space Agency, Millennium Conference on Antennas & Propagation, Apr. 9-14, 2000.

* cited by examiner

MULTIBAND ANTENNA

The present application is a continuation of of international patent application PCT/EP01/11912, filed Oct. 16, 2001.

OBJECT AND BACKGROUND OF THE INVENTION

The present invention relates generally to a new family of antennas with a multiband behaviour. The general configuration of the antenna consists of a multilevel structure which provides the multiband behaviour. A description on Multilevel Antennas can be found in Patent Publication No. WO01/22528. In the present invention, a modification of said multilevel structure is introduced such that the frequency bands of the antenna can be tuned simultaneously to the main existing wireless services. In particular, the modification consists of shaping at least one of the gaps between some of the polygons in the form of a non-straight curve.

Several configurations for the shape of said non-straight curve are allowed within the scope of the present invention. Meander lines, random curves or space-filling curves, to name some particular cases, provide effective means for conforming the antenna behaviour. A thorough description of Space-Filling curves and antennas is disclosed in patent "Space-Filling Miniature Antennas" (Patent Publication No. WO01/54225).

Although patent publications WO01/22528 and WO01/54225 disclose some general configurations for multiband and miniature antennas, an improvement in terms of size, bandwidth and efficiency is obtained in some applications when said multilevel antennas are set according to the present invention. Such an improvement is achieved mainly due to the combination of the multilevel structure in conjunction of the shaping of the gap between at least a couple of polygons on the multilevel structure. In some embodiments, the antenna is loaded with some capacitive elements to finely tune the antenna frequency response.

In some particular embodiments of the present invention, the antenna is tuned to operate simultaneously at five bands, those bands being for instance GSM900 (or AMPS), GSM1800, PCS1900, UMTS, and the 2.4 GHz band for services such as for instance Bluetooth™, IEEE802.11b and HiperLAN. There is in the prior art one example of a multilevel antenna which covers four of said services, see embodiment (3) in FIG. 1, but there is not an example of a design which is able to integrate all five bands corresponding to those services aforementioned into a single antenna.

The combination of said services into a single antenna device provides an advantage in terms of flexibility and functionality of current and future wireless devices. The resulting antenna covers the major current and future wireless services, opening this way a wide range of possibilities in the design of universal, multi-purpose, wireless terminals and devices that can transparently switch or simultaneously operate within all said services.

SUMMARY OF THE INVENTION

The key point of the present invention consists of combining a multilevel structure for a multiband antenna together with an especial design on the shape of the gap or spacing between two polygons of said multilevel structure. A multilevel structure for an antenna device consists of a conducting structure including a set of polygons, all of said polygons featuring the same number of sides, wherein said polygons are electromagnetically coupled either by means of a capacitive coupling or ohmic contact, wherein the contact region between directly connected polygons is narrower than 50% of the perimeter of said polygons in at least 75% of said polygons defining said conducting multilevel structure. In this definition of multilevel structures, circles and ellipses are included as well, since they can be understood as polygons with a very large (ideally infinite) number of sides.

Some particular examples of prior-art multilevel structures for antennas are found in FIG. 1. A thorough description on the shapes and features of multilevel antennas is disclosed in patent publication WO01/22528. For the particular case of multilevel structure described in drawing (3), FIG. 1 and in FIG. 2, an analysis and description on the antenna behaviour is found in (J. Ollikainen, O. Kivekäs, A. Toropainen, P. Vainikainen, "Internal Dual-Band Patch Antenna for Mobile Phones", APS-2000 Millennium Conference on Antennas and Propagation, Davos, Switzerland, April 2000).

When the multiband behaviour of a multilevel structure is to be packed in a small antenna device, the spacing between the polygons of said multilevel structure is minimized. Drawings (3) and (4) in FIG. 1 are some examples of multilevel structures where the spacing between conducting polygons (rectangles and squares in these particular cases) take the form of straight, narrow gaps.

In the present invention, at least one of said gaps is shaped in such a way that the whole gap length is increased yet keeping its size and the same overall antenna size. Such a configuration allows an effective tuning of the frequency bands of the antenna, such that with the same overall antenna size, said antenna can be effectively tuned simultaneously to some specific services, such as for instance the five frequency bands that cover the services AMPS, GSM900, GSM1800, PCS1900, UMTS, Bluetooth™, IEEE802.11b or HyperLAN.

FIGS. 3 to 7 show some examples of how the gap of the antenna can be effectively shaped according to the present invention. For instance, gaps (109), (110), (112), (113), (114), (116), (118), (120), (130), (131), and (132) are examples of non-straight gaps that take the form of a curved or branched line. All of them have in common that the resonant length of the multilevel structure is changed, changing this way the frequency behaviour of the antenna. Multiple configurations can be chosen for shaping the gap according to the present invention:

a) A meandering curve.
b) A periodic curve.
c) A branching curve, with a main longer curve with one or more added segments or branching curves departing from a point of said main longer curve.
d) An arbitrary curve with 2 to 9 segments.
e) An space-filling curve.

An Space-Filling Curve (hereafter SFC) is a curve that is large in terms of physical length but small in terms of the area in which the curve can be included. More precisely, the following definition is taken in this document for a space-filling curve: a curve composed by at least ten segments which are connected in such a way that each segment forms an angle with their neighbours, that is, no pair of adjacent segments define a larger straight segment, and wherein the curve can be optionally periodic along a fixed straight direction of space if, and only if, the period is defined by a non-periodic curve composed by at least ten connected segments and no pair of said adjacent and connected segments defines a straight longer segment. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the gap according to the present invention, the segments of the SFC curves included in said multilevel structure must be shorter than a tenth of the free-space operating wavelength.

It is interesting noticing that, even though ideal fractal curves are mathematical abstractions and cannot be physically implemented into a real device, some particular cases of SFC can be used to approach fractal shapes and curves, and therefore can be used as well according to the scope and spirit of the present invention.

The advantages of the antenna design disclosed in the present invention are:

(a) The antenna size is reduced with respect to other prior-art multilevel antennas.

(b) The frequency response of the antenna can be tuned to five frequency bands that cover the main current and future wireless services (among AMPS, GSM900, GSM1800, PCS1900, Bluetooth™, IEEE802.11b and HiperLAN).

Those skilled in the art will notice that current invention can be applied or combined to many existing prior-art antenna techniques. The new geometry can be, for instance, applied to microstrip patch antennas, to Planar Inverted-F antennas (PIFAs), to monopole antennas and so on. FIGS. 6 and 7 describe some patch of PIFA like configurations. It is also clear that the same antenna geometry can be combined with several ground-planes and radomes to find applications in different environments: handsets, cellular phones and general handheld devices; portable computers (Palmtops, PDA, Laptops, . . . ), indoor antennas (WLAN, cellular indoor coverage), outdoor antennas for microcells in cellular environments, antennas for cars integrated in rear-view mirrors, stop-lights, bumpers and so on.

In particular, the present invention can be combined with the new generation of ground-planes described in the PCT application entitled "Multilevel and Space-Filling Ground-planes for Miniature and Multiband Antennas", which describes a ground-plane for an antenna device, comprising at least two conducting surfaces, said conducting surfaces being connected by at least a conducting strip, said strip being narrower than the width of any of said two conducting surfaces.

When combined to said ground-planes, the combined advantages of both inventions are obtained: a compact-size antenna device with an enhanced bandwidth, frequency behaviour, VSWR, and efficiency.

Gaps (109) and (110) between rectangles (102) and (104) of design (3) are shaped as non-straight curves (109) according to the present invention.

Figure 4:
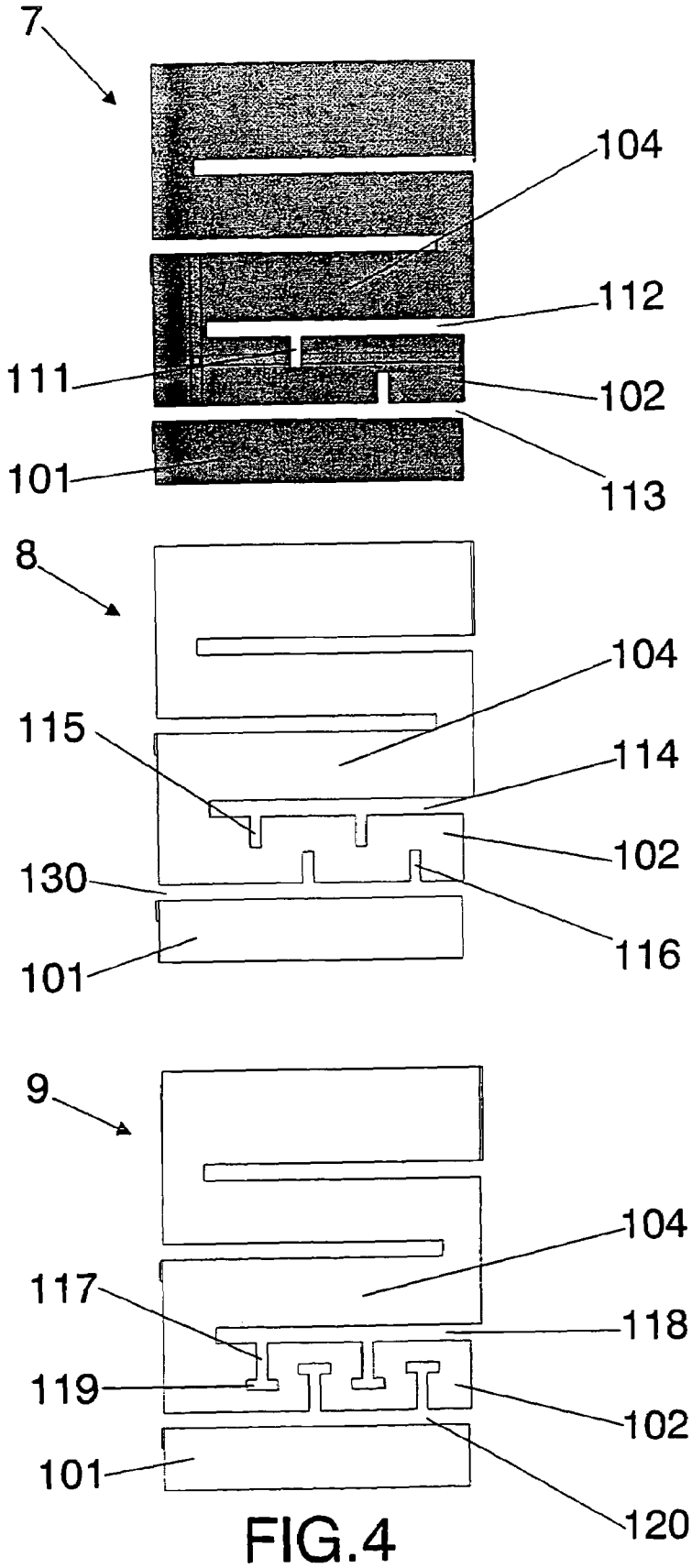

FIG. 4 shows three examples of embodiments (7), (8), (9) for the present invention. All three have in common that include branching gaps (112), (113), (114), (130), (118), (120).

Figure 5:
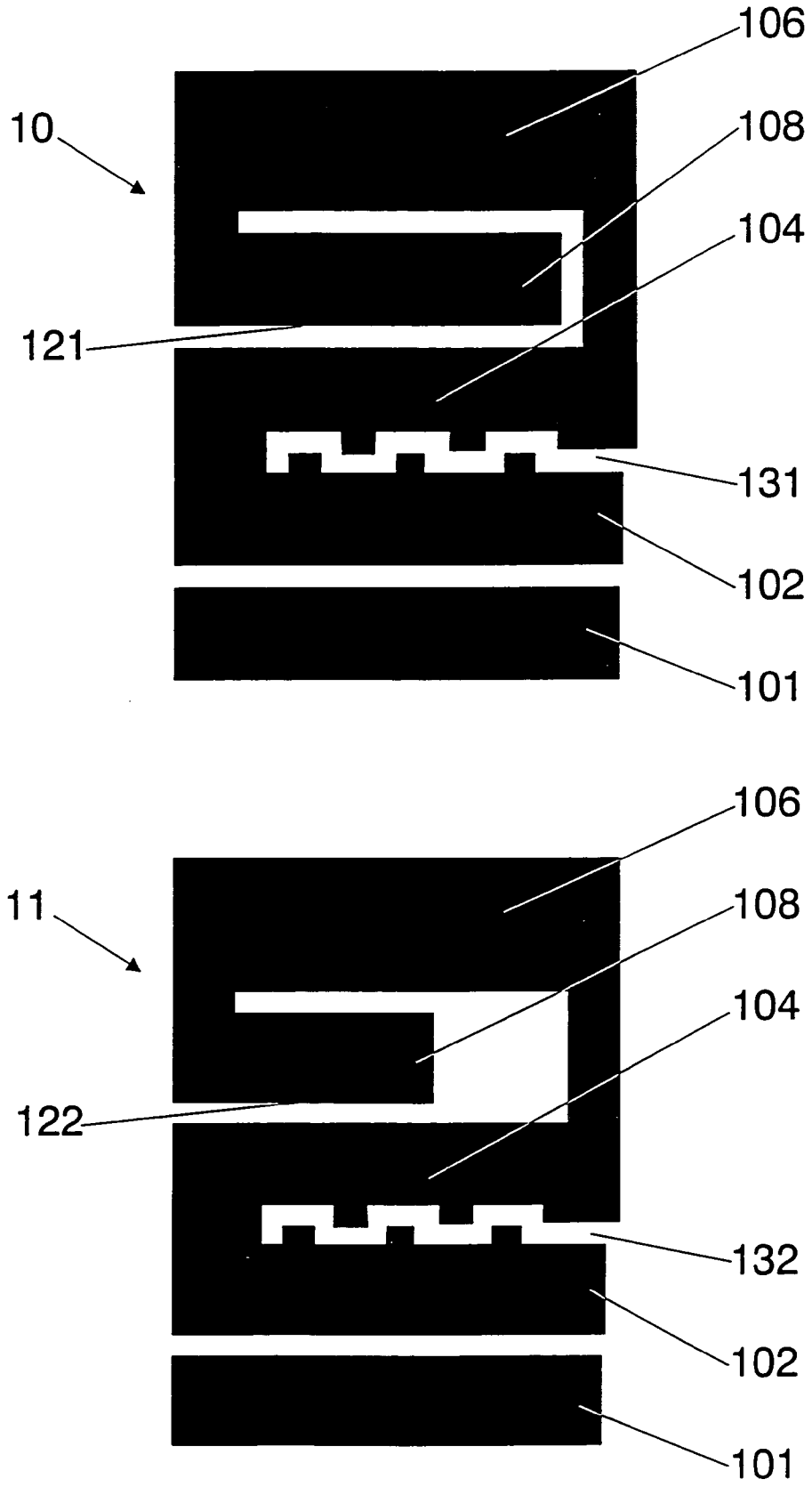

FIG. 5 shows two particular embodiments (10) and (11) for the present invention. The multilevel structure consists of a set of eight rectangles as in the case of design (3), but rectangle (108) is placed between rectangle (104) and (106). Non-straight, shaped gaps (131) and (132) are placed between polygons (102) and (104).

Figure 6:
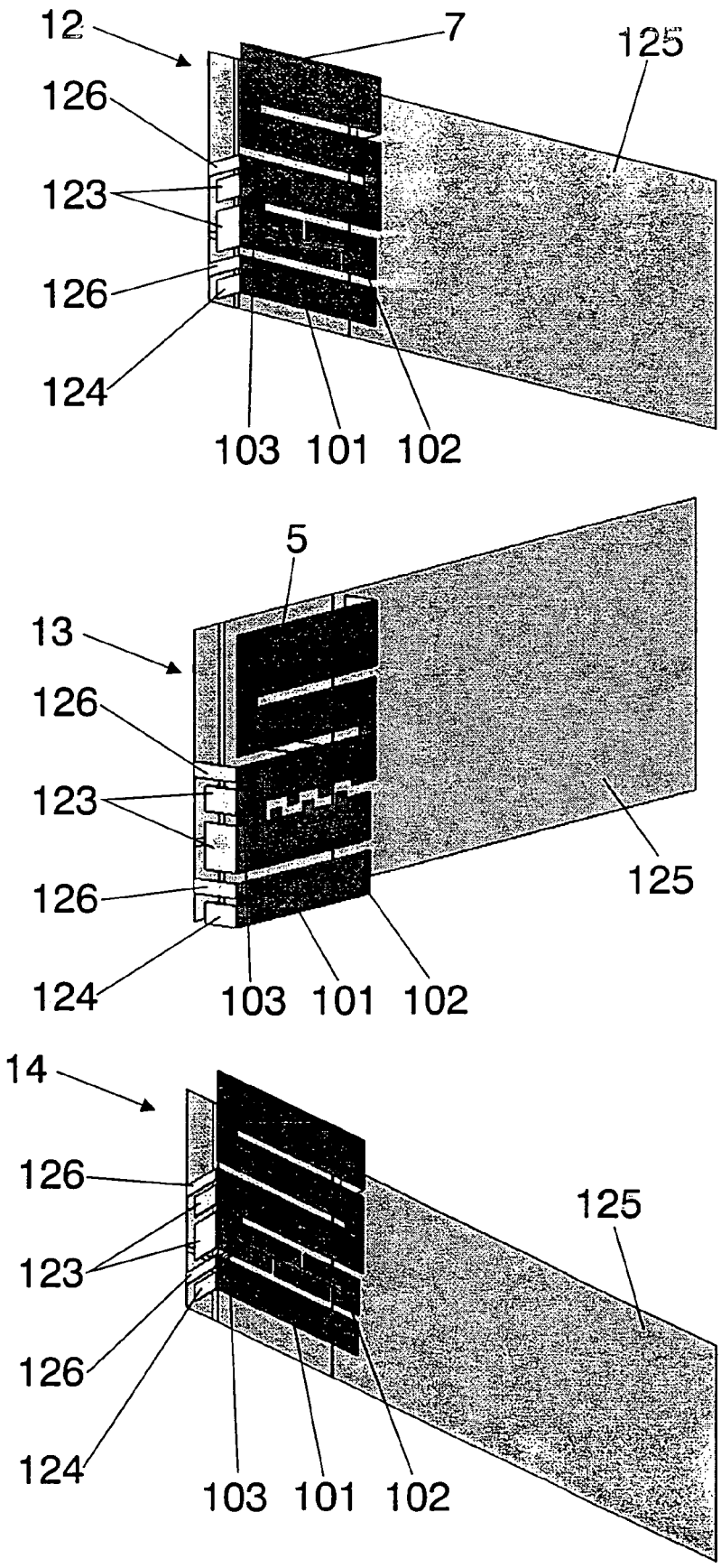

FIG. 6 shows three particular embodiments (12), (13), (14) for three complete antenna devices based on the combined multilevel and gap-shaped structure disclosed in the present invention. All three are mounted in a rectangular ground-plane such that the whole antenna device can be, for instance, integrated in a handheld or cellular phone. All three include two-loading capacitors (123) and (124) in rectangle (103), and a loading capacitor (124) in rectangle (101). All of them include two short-circuits (126) on polygons (101) and (103) and are fed by means of a pin or coaxial probe in rectangles (102) or (103).

Figure 7:
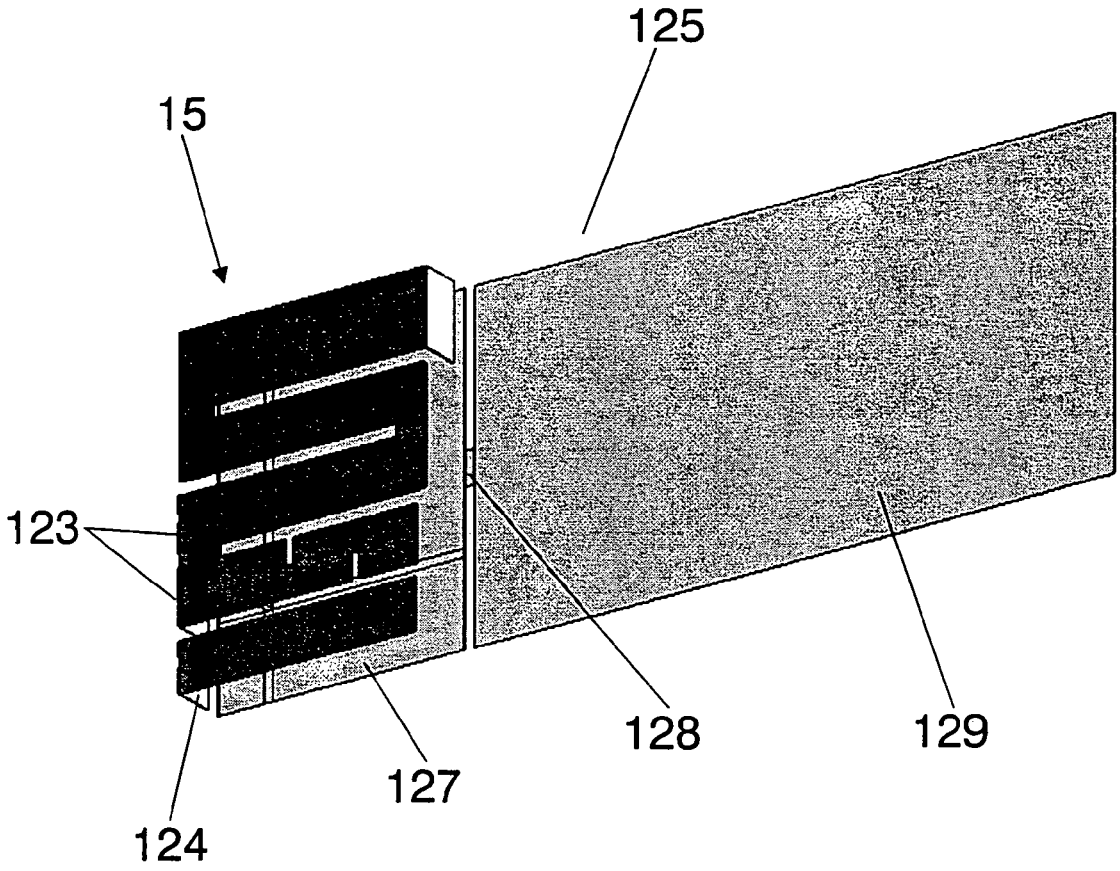

FIG. 7 shows a particular embodiment (15) of the invention combined with a particular case of Multilevel and Space-Filling ground-plane according to the PCT application entitled "Multilevel and Space-Filling Ground-planes for Miniature and Multiband Antennas". In this particular case, ground-plane (125) is formed by two conducting surfaces (127) and (129) with a conducting strip (128) between said two conducting surfaces.

DETAILED DESCRIPTION OF THE PREFERRED EMBODIMENTS

Figure 1:
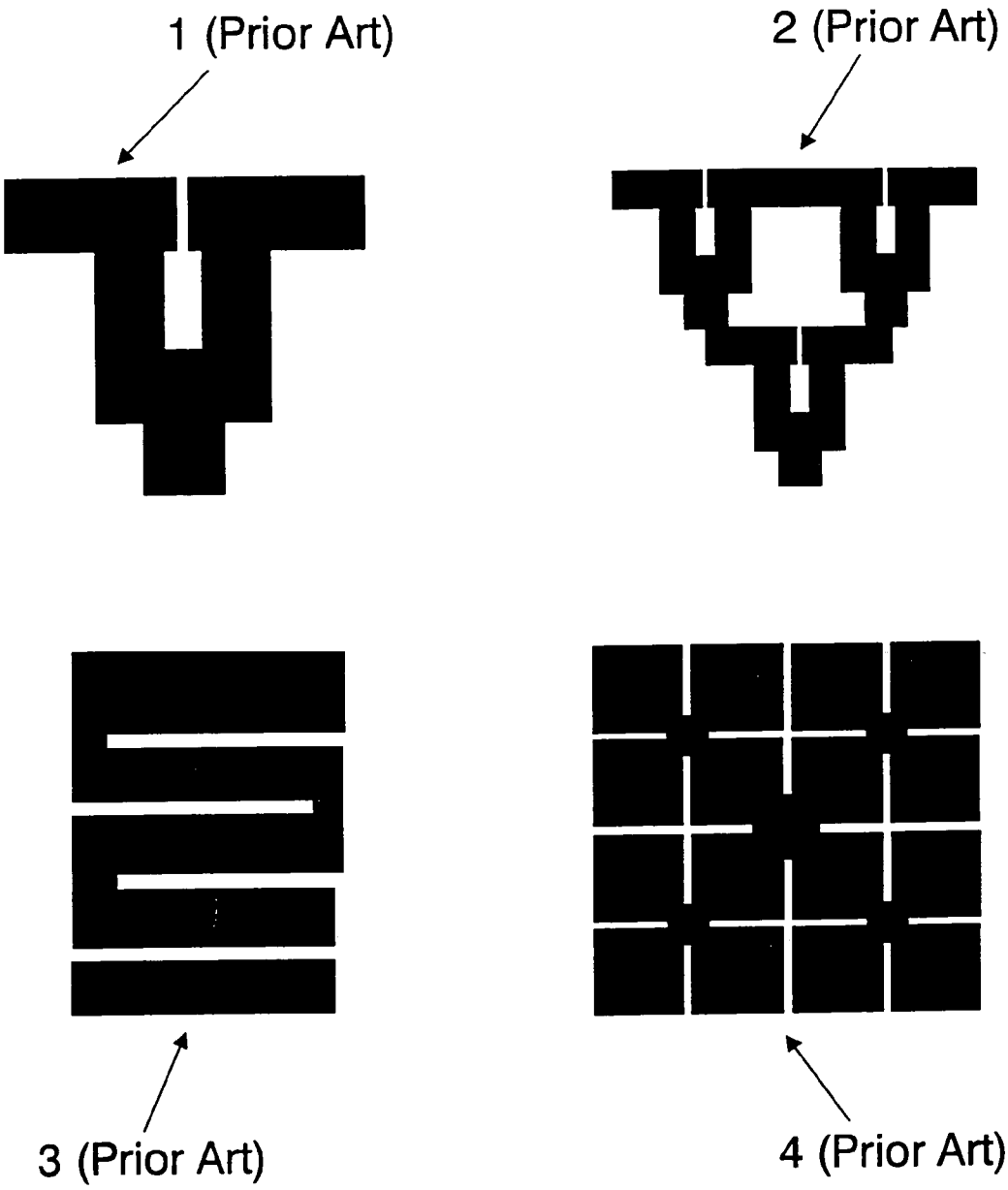
FIG. 1 describes four particular examples (1), (2), (3), (4) of prior-art multilevel geometries for multilevel antennas.
Figure 2:
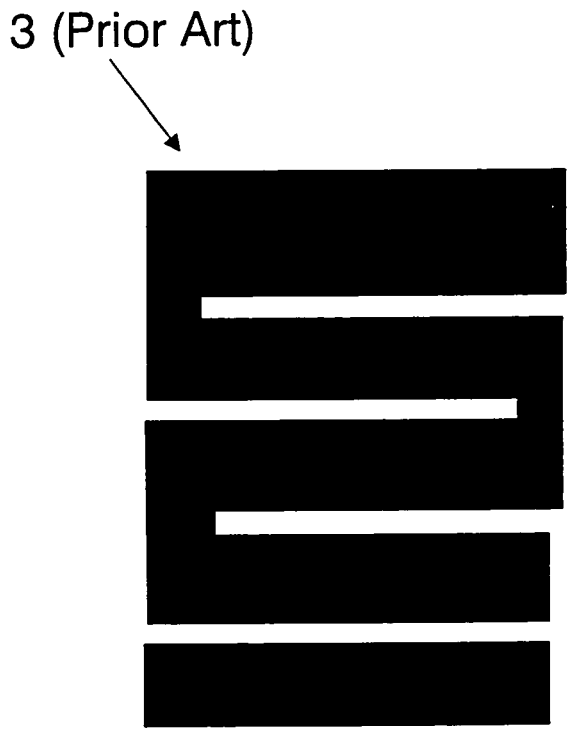
FIG. 2 describes a particular case of a prior-art multilevel antenna formed with eight rectangles (101), (102), (103), (104), (105), (106), (107), and (108).
Figure 2:
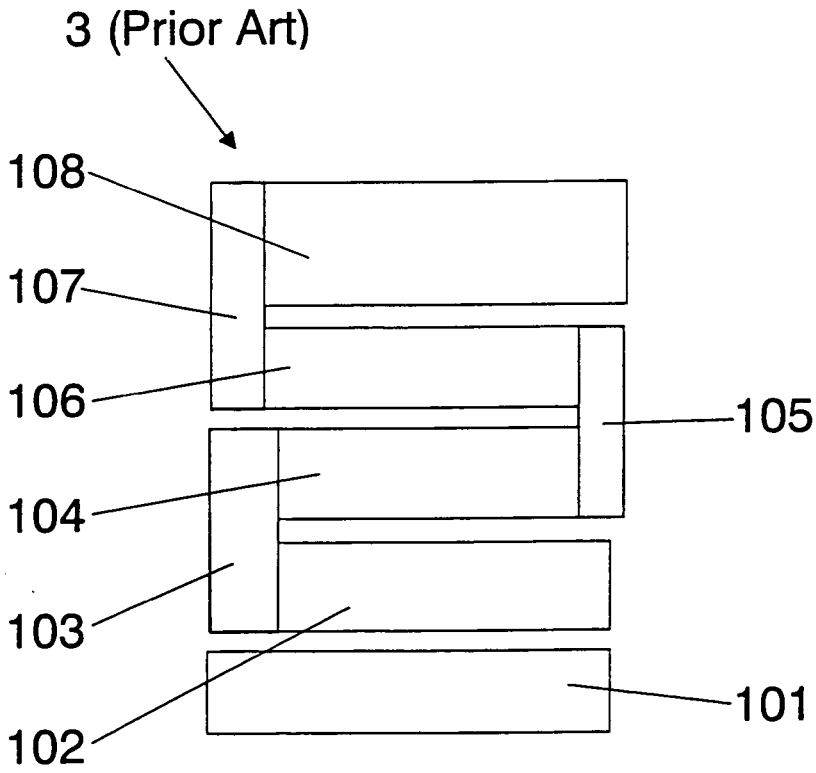
Figure 3:
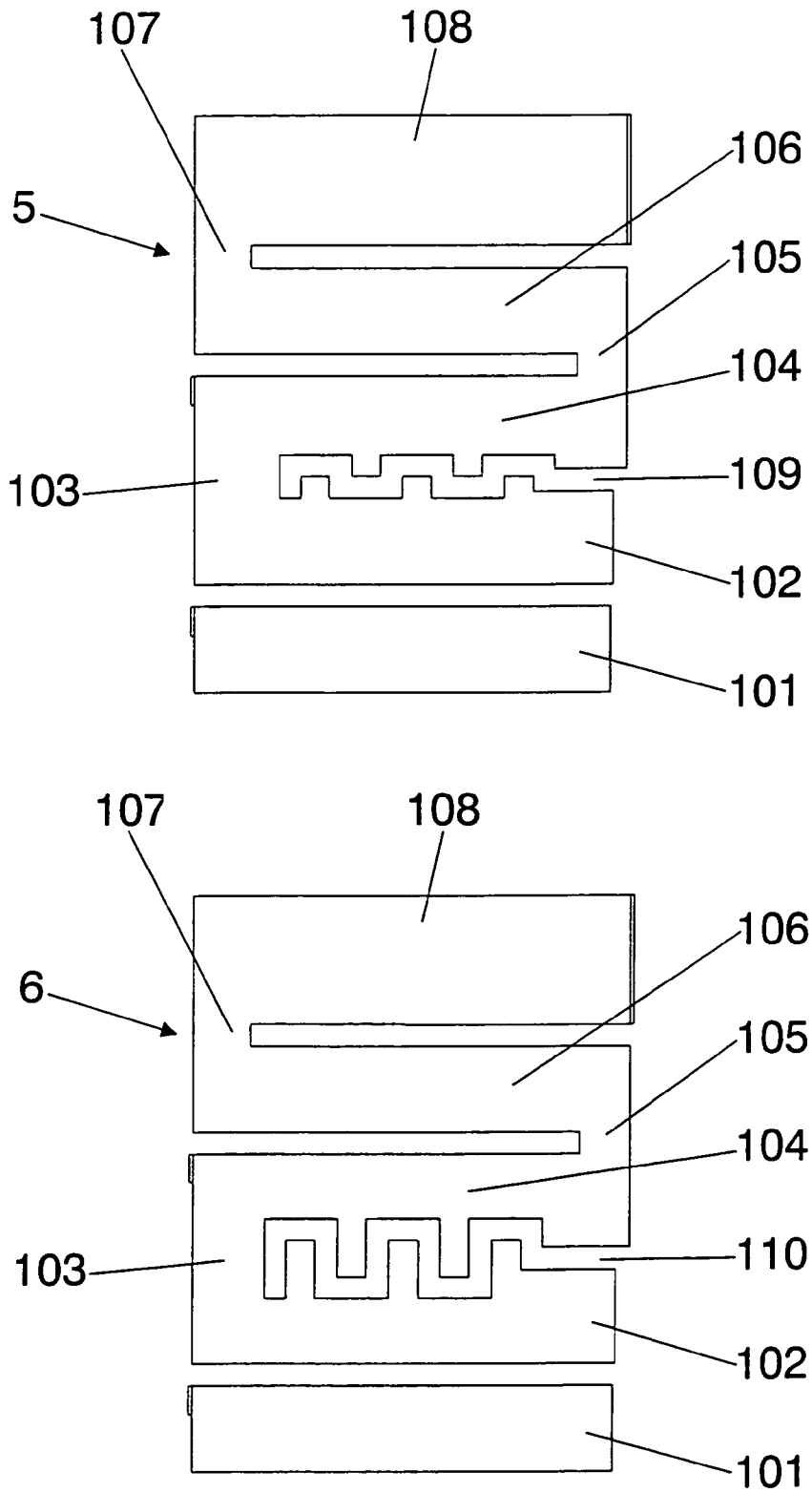
FIG. 3 drawings (5) and (6) show two embodiments of the present invention.

Drawings (5) and (6) in FIG. 3 show two particular embodiments of the multilevel structure and the non-linear gap according to the present invention. The multilevel structure is based on design (3) in FIG. 2 and it includes eight conducting rectangles: a first rectangle (101) being capacitively coupled to a second rectangle (102), said second rectangle being connected at one tip to a first tip of a third rectangle (103), said third rectangle being substantially orthogonal to said second rectangle, said third rectangle being connected at a second lip to a first tip of a fourth rectangle (104), said fourth rectangle being substantially orthogonal to said third rectangle and substantially parallel to said second rectangle, said fourth rectangle being connected at a second tip to a first tip of a fifth rectangle (105), said fifth rectangle being substantially orthogonal to said fourth rectangle and substantially parallel to said third rectangle, said fifth rectangle being connected at a second tip to a first tip of a sixth rectangle (106), said sixth rectangle being substantially orthogonal to said fifth rectangle and substantially parallel to said fourth rectangle, said sixth rectangle being connected at a second tip to a first tip of a seventh rectangle (107), said seventh rectangle being substantially orthogonal to said sixth rectangle and parallel to said fifth rectangle, said seventh rectangle being connected to a first tip of an eighth rectangle (108), said eighth rectangle being substantially orthogonal to said seventh rectangle and substantially parallel to said sixth rectangle.

Both designs (5) and (6) include a non-straight gap (109) and (110) respectively, between second (102) and fourth (104) polygons. It is clear that the shape of the gap and its physical length can be changed. This allows a fine tuning of the antenna to the desired frequency bands in case the conducting multilevel structure is supported by a high permittivity substrate.

The advantage of designs (5) and (6) with respect to prior art is that they cover five bands that include the major existing wireless and cellular systems (among AMPS, GSM900, GSM1800, PCS1900, UMTS, Bluetooth™, IEEE802.11b, HiperLAN).

Three other embodiments for the invention are shown in FIG. 4. All three are based on design (3) but they include two shaped gaps. These two gaps are placed between rectangle (101) and rectangle (102), and between rectangle (102) and (104) respectively. In these examples, the gaps take the form of a branching structure. In embodiment (7) gaps (112) and (113) include a main gap segment plus a minor gap-segment (111) connected to a point of said main gap segment. In embodiment (8), gaps (114) and (116) include respectively two minor gap-segments such as (115). Many other branching structures can be chosen for said gaps according to the present invention, and for instance more convoluted shapes for the minor gaps as for instance (117) and (119) included in gaps (118) and (120) in embodiment (9) are possible within the scope and spirit of the present invention.

Although design in FIG. 3 has been taken as an example for embodiments in FIGS. 3 and 4, other eight-rectangle multilevel structures, or even other multilevel structures with a different number of polygons can be used according to the present invention, as long as at least one of the gaps between two polygons is shaped as a non-straight curve. Another example of an eight-rectangle multilevel structure is shown in embodiments (10) and (11) in FIG. 5. In this case, rectangle (108) is placed between rectangles (106) and (104) respectively. This contributes in reducing the overall antenna size with respect to design (3). Length of rectangle (108) can be adjusted to finely tune the frequency response of the antenna (different lengths are shown as an example in designs (10) and (11)) which is useful when adjusting the position of some of the frequency bands for future wireless services, or for instance to compensate the effective dielectric permittivity when the structure is built upon a dielectric surface.

FIG. 6 shows three examples of embodiments (12), (13), and (14) where the multilevel structure is mounted in a particular configuration as a patch antenna. Designs (5) and (7) are chosen as a particular example, but it is obvious that any other multilevel structure can be used in the same manner as well, as for instance in the case of embodiment (14). For the embodiments in FIG. 6, a rectangular ground-plane (125) is included and the antenna is placed at one end of said ground-plane. These embodiments are suitable, for instance, for handheld devices and cellular phones, where additional space is required for batteries and circuitry. The skilled in the art will notice, however, that other ground-plane geometries and positions for the multilevel structure could be chosen, depending on the application (handsets, cellular phones and general handheld devices; portable computers such as Palmtops, PDA, Laptops, indoor antennas for WLAN, cellular indoor coverage, outdoor antennas for microcells in cellular environments, antennas for cars integrated in rear-view mirrors, stop-lights, and bumpers are some examples of possible applications) according to the present invention.

All three embodiments (12), (13), (14) include two-loading capacitors (123) and (124) in rectangle (103), and a loading capacitor (124) in rectangle (101). All of them include two short-circuits (126) on polygons (101) and (103) and are fed by means of a pin or coaxial probe in rectangles (102) or (103). Additionally, a loading capacitor at the end of rectangle (108) can be used for the tuning of the antenna.

It will be clear to those skilled in the art that the present invention can be combined in a novel way to other prior-art antenna configurations. For instance, the new generation of ground-planes disclosed in the PCT application entitled "Multilevel and Space-Filling Ground-planes for Miniature and Multiband Antennas" can be used in combination with the present invention to further enhance the antenna device in terms of size, VSWR, bandwidth, and/or efficiency. A particular case of ground-plane (125) formed with two conducting surfaces (127) and (129), said surfaces being connected by means of a conducting strip (128), is shown as an example in embodiment (15).

The particular embodiments shown in FIGS. 6 and 7 are similar to PIFA configurations in the sense that they include a shorting-plate or pin for a patch antenna upon a parallel ground-plane. The skilled in the art will notice that the same multilevel structure including the non-straight gap can be used in the radiating elements of other possible configurations, such as for instance, monopoles, dipoles or slotted structures.

It is important to stress that the key aspect of the invention is the geometry disclosed in the present invention. The manufacturing process or material for the antenna device is not a relevant part of the invention and any process or material described in the prior-art can be used within the scope and spirit of the present invention. To name some possible examples, but not limited to them, the antenna could be stamped in a metal foil or laminate; even the whole antenna structure including the multilevel structure, loading elements and ground-plane could be stamped, etched or laser cut in a single metallic surface and folded over the short-circuits to obtain, for instance, the configurations in FIGS. 6 and 7. Also, for instance, the multilevel structure might be printed over a dielectric material (for instance FR4, Roger®, Arlon® or Cuclad®) using conventional printing circuit techniques, or could even be deposited over a dielectric support using a two-shot injecting process to shape both the dielectric support and the conducting multilevel structure.

The invention claimed is:

1. A multiband antenna comprising:

a multilevel structure comprising a conducting structure including a set of polygons, all of said polygons having the same number of sides, wherein said polygons are electromagnetically coupled either by means of a capacitive coupling or ohmic contact, and wherein a contact region between directly connected polygons is narrower than 50% of the perimeter of said polygons in at least 75% of said polygons defining said conducting structure;

wherein said set of polygons comprises at least eight polygons; and wherein at least two polygons of the multilevel structure are spaced by means of a non-straight gap;

wherein the non-straight gap increases a resonant length of the multiband antenna but does not increase an overall physical size of the multiband antenna; and wherein the overall physical size of the multiband antenna is defined by the outer dimensions of the multiband antenna.

2. A multiband antenna according to claim 1 wherein the non-straight gap approximates a fractal shape or curve.

3. A multiband antenna according to claims 1 or 2, wherein the multilevel structure comprises at least eight rectangles, a first rectangle being capacitively coupled to a second rectangle, said second rectangle being connected at one tip to a first tip of a third rectangle, said third rectangle being substantially orthogonal to said second rectangle, said third rectangle being connected at a second tip to a first tip of a fourth rectangle, said fourth rectangle being substantially orthogonal to said third rectangle and substantially parallel to said second rectangle, said fourth rectangle being connected at a second tip to a first tip of a fifth rectangle, said fifth rectangle being substantially orthogonal to said fourth rectangle and substantially parallel to said third rectangle, said fifth rectangle being connected at a second tip to a first tip of a sixth rectangle, said sixth rectangle being substantially orthogonal to said fifth rectangle and substantially parallel to said fourth rectangle, said sixth rectangle being connected at a second tip to a first tip of a seventh rectangle, said seventh rectangle being substantially orthogonal to said sixth rectangle and parallel to said fifth rectangle, said seventh rectangle being connected to a first tip of an eighth rectangle, said eighth rectangle being substantially orthogonal to said seventh rectangle and substantially parallel to said sixth rectangle.

4. A multiband antenna according to claims 1 or 2, wherein the multilevel structure comprises at least eight rectangles, a first rectangle being capacitively coupled to a second rectangle, said second rectangle being connected at one tip to a first tip of a third rectangle, said third rectangle being substantially orthogonal to said second rectangle, said third rectangle being connected at a second tip to a first tip of a fourth rectangle, said fourth rectangle being substantially orthogonal to said third rectangle and substantially parallel to said second rectangle, said fourth rectangle being connected at a second tip to a first tip of a fifth rectangle, said fifth rectangle being substantially orthogonal to said fourth rectangle and substantially parallel to said third rectangle, said fifth rectangle being connected at a second tip to a first tip of a sixth rectangle, said sixth rectangle being substantially orthogonal to said fifth rectangle and substantially parallel to said fourth rectangle, said sixth rectangle being connected at a second tip to a first tip of a seventh rectangle, said seventh rectangle being substantially orthogonal to said sixth rectangle and parallel to said fifth rectangle, said seventh rectangle being connected to a first tip of an eight rectangle, said eighth rectangle being substantially orthogonal to said seventh rectangle and substantially parallel to said sixth rectangle, and wherein said eight eighth rectangle is placed between said fourth and sixth rectangles.

5. A multiband antenna according to claim 1, wherein the multiband antenna operates at five bands, and wherein the multilevel structure is placed at one end of a rectangular ground-plane and substantially parallel to said ground-plane.

6. A multiband antenna according to claim 1, wherein the multiband antenna operates at five bands, and wherein the antenna is fed by means of a straight pin to a point on the second or third rectangle of said multilevel structure and wherein the antenna is matched below a VSWR<3 at the frequency bands of at least one of the following five wireless services: GSM900, GSM1800, PCS1900, UMTS and 2.4 GHz.

7. A multiband antenna according to claim 1, wherein the multiband antenna operates at five bands, and wherein the multilevel structure is placed over a Multilevel and Space-Filling Ground-Plane which includes at least two conducting surfaces, said conducting surfaces being connected by at least a conducting strip, said strip being narrower than the width of any of said two conducting surfaces.

8. A multiband antenna according to claim 1, wherein the multiband antenna operates at five bands, and wherein the multilevel structure is placed over a rectangular ground-plane, said ground-plane including at least one slot in at least one of its edges.

9. A multiband antenna according to claim 1, wherein the multiband antenna operates at five bands, and wherein the antenna is placed inside a cellular phone or handheld wireless terminal.

10. A multiband antenna according to claim 4, wherein the multiband antenna operates at five bands, and wherein the antenna is placed inside a cellular phone or handheld wireless terminal.

11. The multiband antenna according to claim 1, wherein the multilevel structure is composed by at least eight polygons.

12. The multiband antenna according to claim 1, wherein the multiband antenna includes at least a first capacitive load on the multilevel structure.

13. The multiband antenna according to claim 1, wherein at least a first polygon of said multilevel structure is capacitively coupled to a second polygon of said multilevel structure.

14. The multiband antenna according to claim 1, wherein the non-straight gap is shaped as a space-filling curve.

15. The multiband antenna according to claim 14, wherein the space-filling curve is composed of at least ten segments which are connected in such a way that each segment forms an angle with adjacent segments so that no pair of adjacent segments defines a larger straight segment, and wherein, if the space-filling curve is periodic along a fixed straight direction of space, the corresponding period is defined by a non-periodic curve composed of at least ten connected segments of which no pair of adjacent ones of the connected segments defines a straight longer segment, and wherein the space-filling curve does not intersect with itself at any point or intersects with itself only at an initial and final point of the space-filling curve, and wherein the segments of the space-filling curve are shorter than a tenth of the free-space operating wavelength of the antenna.

16. A multiband antenna configured to operate at five bands, the multiband antenna comprising:

a multilevel structure comprising a conducting structure including a set of polygons, all of said polygons having the same number of sides, wherein said polygons are electromagnetically coupled either by means of a capacitive coupling or ohmic contact, and wherein a contact region between directly connected polygons is narrower than 50% of the perimeter of said polygons in at least 75% of said polygons defining said conducting structure;

wherein said set of polygons comprises at least eight polygons; and wherein at least two polygons of the multilevel structure are spaced by means of a non-straight gap and at least two polygons of the multilevel structure are quadrangles;

wherein the non-straight gap increases a resonant length of the multiband antenna but does not increase an overall physical size of the multiband antenna; and wherein the overall physical size of the multiband antenna is defined by the outer dimensions of the multiband antenna.

17. A multiband antenna according to claim 16, wherein the multilevel structure comprises at least eight rectangles, a first rectangle being capacitively coupled to a second rectangle, said second rectangle being connected at one tip to a first tip of a third rectangle, said third rectangle being substantially orthogonal to said second rectangle, said third rectangle being connected at a second tip to a first tip of a fourth rectangle, said fourth rectangle being substantially orthogonal to said third rectangle and substantially parallel to said second rectangle, said fourth rectangle being connected at a second tip to a first tip of a fifth rectangle, said fifth rectangle being substantially orthogonal to said fourth rectangle and substantially parallel to said third rectangle, said fifth rectangle being connected at a second tip to a first tip of a sixth rectangle, said sixth rectangle being substantially orthogonal to said fifth rectangle and substantially parallel to said fourth rectangle, said sixth rectangle being connected at a second tip to a first tip of a seventh rectangle, said seventh rectangle being substantially orthogonal to said sixth rectangle and parallel to said fifth rectangle, said seventh rectangle being connected to a first tip of an eighth rectangle, said eighth rectangle being substantially orthogonal to said seventh rectangle and substantially parallel to said sixth rectangle.

18. A multiband antenna according to claim 17, wherein the non-straight gap is placed between said second and fourth rectangle.

19. A multiband antenna according to claim 18, wherein the multiband antenna includes at least a first short-circuit and a second short-circuit between the multilevel structure and the ground-plane, a first short-circuit being connected to one edge on the tip of a first polygon of said multilevel structure and a second short-circuit being connected at one edge of a second polygon of said multilevel structure.

20. A multiband antenna according to claim 16, wherein the multiband antenna includes at least a first and a second capacitive load on the multilevel structure, said capacitive load including a conducting strip, said conducting strip being connected at one edge of said multilevel structure and being placed orthogonally to said multilevel structure between the multilevel structure and a ground-plane.

21. A multiband antenna according to claim 20, wherein the multiband antenna includes at least a first capacitive load connected a tip of one of the polygons of the multiband antenna.

22. A multiband antenna according to 20, wherein the multiband antenna includes at least three capacitive loads, a first capacitive load being connected at one edge of a first polygon of said multilevel structure, and a second and a third capacitive load being connected at one edge of a second polygon of said multilevel structure.

23. The multiband antenna according to claim 16, wherein the non-straight gap is shaped as a space-filling curve.

24. The multiband antenna according to claim 23, wherein the space-filling curve is composed of at least ten segments which are connected in such a way that each segment forms an angle with adjacent segments so that no pair of adjacent segments defines a larger straight segment, and wherein, if the space-filling curve is periodic along a fixed straight direction of space, the corresponding period is defined by a non-periodic curve composed of at least ten connected segments of which no pair of adjacent ones of the connected segments defines a straight longer segment, and wherein the space-filling curve does not intersect with itself at any point or intersects with itself only at an initial and final point of the space-filling curve, and wherein the segments of the space-filling curve are shorter than a tenth of the free-space operating wavelength of the antenna.

25. An antenna, comprising:

a first conducting portion;

a second conducting portion electromagnetically coupled to the first conducting portion;

the first and second conducting portions defining a non-straight gap therebetween;

wherein the non-straight gap increases a resonant length of the antenna, but does not increase the outer dimensions of the antenna; and a multilevel structure comprising at least eight polygons, the multilevel structure comprising a conducting structure including a set of polygons, all of said polygons having the same number of sides, wherein said polygons are electromagnetically coupled either by means of a capacitive coupling or ohmic contact, and wherein a contact region between directly connected polygons is narrower than 50% of the perimeter of said polygons in at least 75% of said polygons defining said conducting structure.

26. The antenna of claim 25, wherein the non-straight gap defines a space-filling curve.

27. The antenna of claim 26, wherein the space-filling curve approximates a fractal shape or curve.

28. The multiband antenna according to claim 26, wherein the space-filling curve is composed of at least ten segments which are connected in such a way that each segment forms an angle with adjacent segments so that no pair of adjacent segments defines a larger straight segment, and wherein, if the space-filling curve is periodic along a fixed straight direction of space, the corresponding period is defined by a non-periodic curve composed of at least ten connected segments of which no pair of adjacent ones of the connected segments defines a straight longer segment, and wherein the space-filling curve does not intersect with itself at any point or intersects with itself only at an initial and final point of the space-filling curve, and wherein the segments of the space-filling curve are shorter than a tenth of the free-space operating wavelength of the antenna.

29. The antenna of claim 25, wherein the non-straight gap defines a meandering curve.

30. The antenna of claim 25, wherein the non-straight gap defines a periodic curve.

31. The antenna of claim 25, wherein the non-straight gap defines a branching structure having a main gap segment and at least one minor gap segment that extends from the main gap segment.

32. The antenna of claim 25, wherein the non-straight gap defines a curve having between two and nine segments.

33. The antenna of claim 25, wherein the first and second conducting portions are electromagnetically coupled by means of capacitive coupling.

34. The antenna of claim 25, wherein the first and second conducting portions are electromagnetically coupled by means of ohmic contact.

35. The antenna of claim 25, wherein the antenna operates at five bands, and wherein the antenna comprises a multilevel structure placed at one end of a rectangular ground-plane and substantially parallel to said ground-plane.

36. The antenna of claim 25, wherein the antenna operates at five bands, and wherein the antenna comprises a multilevel structure placed over a Multilevel and Space-Filling Ground-Plane including the two conducting portions, said conducting portions being connected by at least a conducting strip, said strip being narrower than the width of any of said two conducting portions.

37. The antenna of claim 25, wherein the antenna operates at five bands, and wherein the antenna comprises a multilevel structure placed over a rectangular ground-plane, said ground-plane including at least one slot in at least one of its edges.

38. The antenna of claim 25, wherein the multiband antenna operates at five bands, and wherein the antenna is placed inside a cellular phone or handheld wireless terminal.

39. The antenna of claim 25, wherein the second conducting portion is shorter than the first conducting portion.

40. The antenna of claim 25, wherein a width of the non-straight gap is non-constant.

41. The antenna of claim 25, wherein the antenna comprises a multilevel structure comprising at least eight rectangles.

42. The antenna of claim 25, wherein the antenna comprises a multilevel structure and includes at least a first and a second capacitive load on the multilevel structure, said capacitive load including a conducting strip, said conducting strip being connected at one edge of said multilevel structure and being placed orthogonally to said multilevel structure between the multilevel structure and a ground-plane.

43. The antenna of claim 25, wherein the antenna operates in at least three frequency bands.

44. The antenna of claim 25, wherein the antenna operates in at least four frequency bands.

45. The antenna of claim 25, wherein the antenna can operate simultaneously in five frequency bands.

46. The antenna of claim 25, wherein the antenna can operate in at least two of the following frequency bands: GSM900, GSM1800, PCS1900, UMTS and 2.4 GHz.

47. The antenna of claim 25, wherein the antenna comprises a multilevel structure and includes at least a first capacitive load on the multilevel structure.

48. The antenna of claim 47, wherein the antenna comprising the multilevel structure further includes a second capacitive load on the multilevel structure.

49. The antenna of claim 47, wherein said capacitive load includes a conducting strip, said conducting strip being connected at one edge of said multilevel structure and being placed orthogonally to said multilevel structure between the multilevel structure and a ground-plane.

* * * * *